United States Patent [19]

Sakamaki et al.

[11] Patent Number: 4,551,896

[45] Date of Patent: Nov. 12, 1985

[54] METHOD OF MANUFACTURING A ROTOR FOR A ROTARY FLUID PUMP

[75] Inventors: Hiroshi Sakamaki, Tochigi; Susumu Sugishita; Yukio Horikoshi, both of Saitama, all of Japan

[73] Assignee: Nippon Piston Ring Co., Ltd., Tokyo, Japan

[21] Appl. No.: 628,212

[22] Filed: Jul. 5, 1984

[30] Foreign Application Priority Data

Jul. 16, 1983 [JP] Japan ..... 58-129794

[51] Int. Cl.[4] ..... B23P 15/00

[52] U.S. Cl. ..... 29/156.4 R; 29/419 R; 29/421 R; 29/421 E; 29/527.1; 29/530; 29/DIG. 11; 29/DIG. 48; 72/274; 72/276; 72/367; 72/402

[58] Field of Search ..... 29/156.4 R, 156.8 R, 29/419 R, 421 R, 421 E, 527.1, 530, DIG. 11, DIG. 48; 72/274, 276, 283, 367, 402

[56] References Cited

U.S. PATENT DOCUMENTS

| | | | |
|---|---|---|---|
| 2,001,643 | 5/1935 | Wilcox | 72/276 |
| 4,510,659 | 4/1985 | Okazaki | 29/156.4 R X |

FOREIGN PATENT DOCUMENTS

| | | | |
|---|---|---|---|
| 710088 | 5/1965 | Canada | 72/402 |
| 1407374 | 6/1965 | France | 72/402 |
| 10430 | 3/1974 | Japan | 72/402 |

*Primary Examiner*—Howard N. Goldberg
*Assistant Examiner*—Ronald S. Wallace
*Attorney, Agent, or Firm*—Finnegan, Henderson, Farabow, Garrett & Dunner

[57] ABSTRACT

A method of forming a rotor for a vane-type rotary pump. The rotor is generally cylindrical with a plurality of vane slots. A tubular member having generally flat sections separated one from the other by corner portions is formed into the rotor by forming the flat sections into slots by deforming the tubular member. The slots are thereafter formed into the vane slots with a die and the corner portions are formed into the outer peripheral surface of the rotor, also using a die.

12 Claims, 12 Drawing Figures

METHOD OF MANUFACTURING A ROTOR FOR A ROTARY FLUID PUMP

BACKGROUND OF THE INVENTION

The present invention relates to an improved method for constructing a rotor for a fluid pump. Rotary fluid pumps are widely used in industrial applications; however, due to their weight there has been a longstanding effort to develop a lightweight rotary fluid pump that is efficient, durable and readily manufactured. In addition, for automotive and transportation applications there is an existing need for lightweight rotary pumps as means for saving energy.

The rotor of such a pump takes up a significant proportion of the inner volume of the pump, and making the rotor lighter in weight significantly improves the performance of the pump. The rotor is, however, subjected to significant stress during operation and any weight savings must also take into account the fact that the rotor must be strong as well as light.

SUMMARY OF THE INVENTION

It is the principal object of the present invention to provide an economic method of making a rotor for a rotary fluid pump that is both lightweight and sufficiently strong such that it can withstand the stresses applied to it during operation.

An additional object is to provide a method of efficiently manufacturing a rotor having an outer periphery made of a high-strength, highly wear-resistant material and an inner portion of a lightweight material.

The present invention comprises a method of forming a rotor for a vane-type rotary fluid pump. The rotor is generally cylindrical with a plurality of vane slots therein. The method first provides a tubular member having a plurality of generally flat sections and a plurality of corner portions between the flat sections. Slots are then formed in the flat sections by deforming the tubular member. The slots are then formed into the vane slots by means of a die, and the corner portions are formed into the outer peripheral surface by means of a die.

Preferably the vane slots and the outer peripheral surface of the rotor are formed in the same forming operation.

Forming such a rotor by the method of the present invention has the advantages noted above. Further objects and advantages will be apparent from the description which follows or can be learned by practice of the invention.

BRIEF DESCRIPTION OF THE DRAWINGS

FIG. 1 is a side elevational view of a tubular member;

FIGS. 2 and 3 are side elavational views illustrative of the step of initially forming the slots;

FIG. 4 is a side elevational view showing the tubular rotor component with the vane slots formed therein;

FIG. 5 is a perspective view of the rotor of FIG. 4 with a shaft fixed to a portion of the rotor body;

FIG. 6 is a perspective view of a completed rotor;

FIG. 7 is a side elevational view of a tubular member;

FIGS. 8 and 9 are side elevational views illustrative of initial steps in forming the vane slots;

FIG. 10 is a side elevational view showing the tubular member formed to a generally cylindrical shape;

FIG. 11 is a side elevational view showing the tubular rotor component with the vane slots formed therein;

DESCRIPTION OF THE PREFERRED EMBODIMENTS

The present invention is a method of forming a rotor for a vane-type rotary fluid pump where the rotor is generally cylindrical and contains a plurality of vane slots. The method of the present invention may be practiced in a number of ways.

Figure 1:
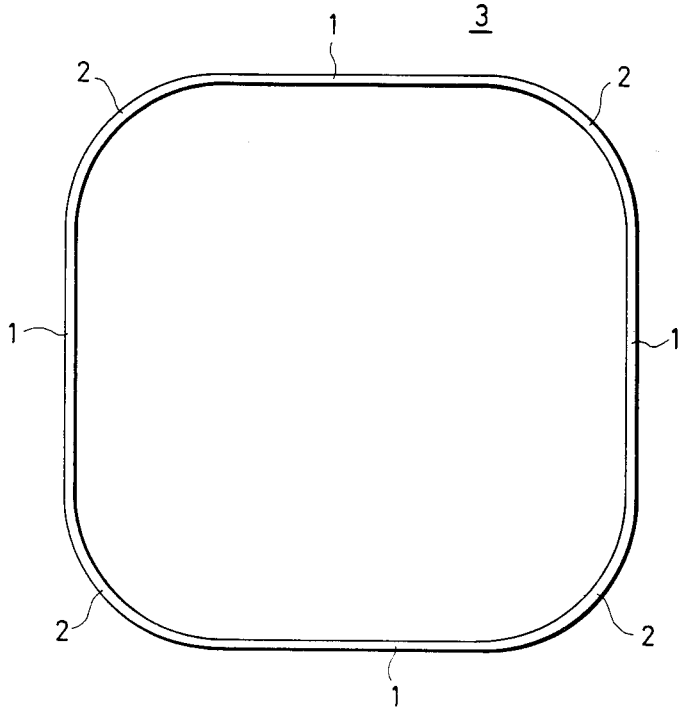
FIGS. 1 through 6 illustrate a first method of practicing the present invention.
Figure 2:
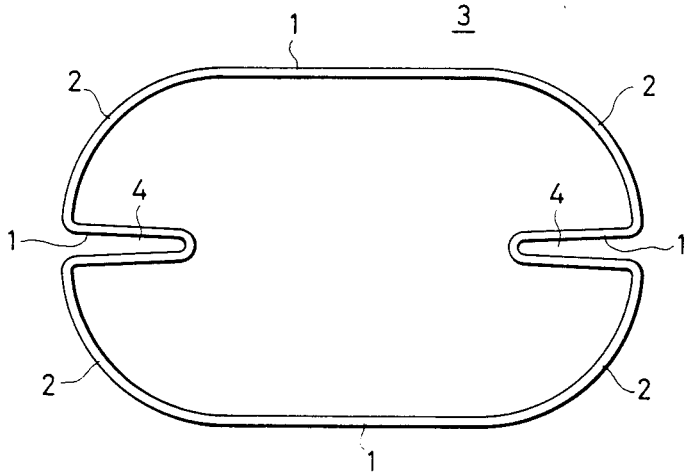
Figure 3:
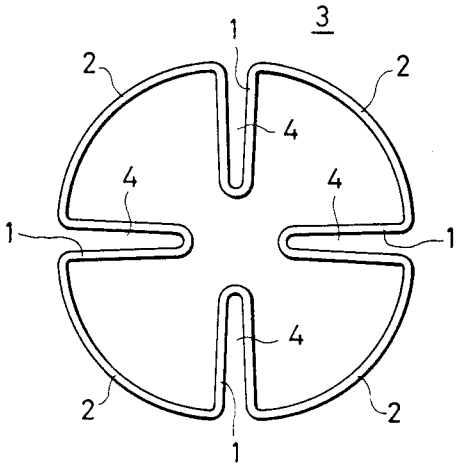
Figure 7:
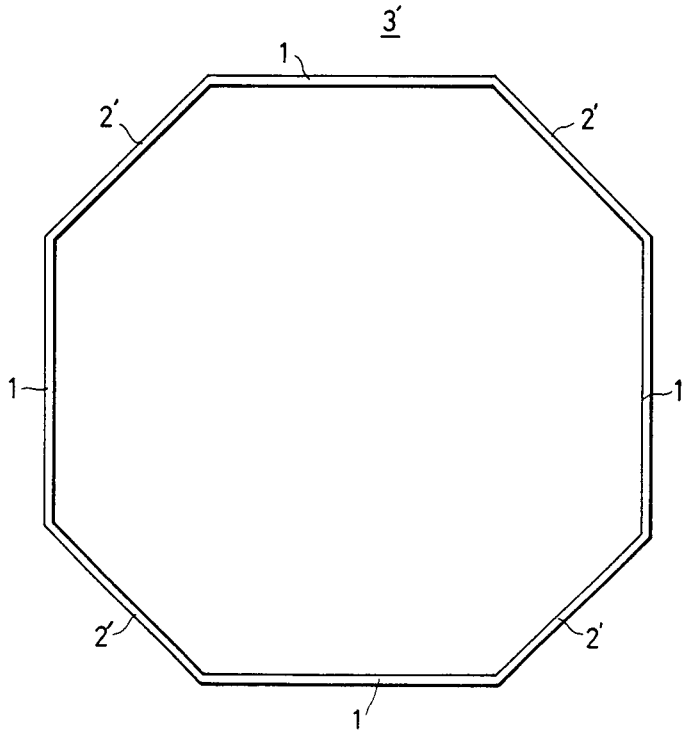
FIGS. 7 through 11 illustrate a second method of practicing the present invention.
Figure 8:
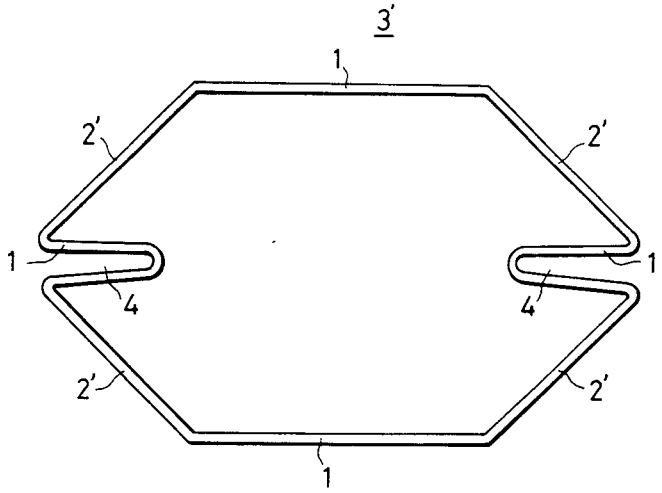
Figure 9:
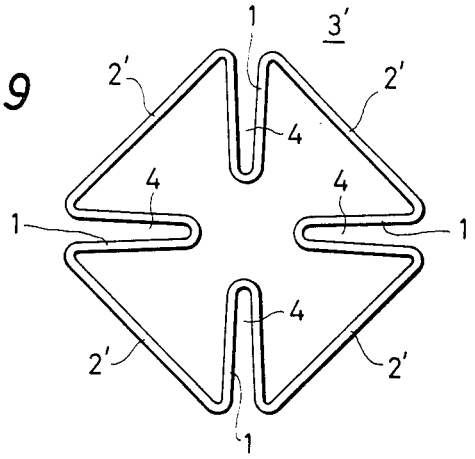

The rotor body is formed from a tubular member having a plurality of generally flat sections and a plurality of corner portions between the sections. As depicted in FIG. 1, the tubular member has flat sections 1 between corner portions 2. By contrast, the octagonal tubular member of FIG. 7 has flat sections 1 with the corner portions 2' also being flat. The tubular member is preferably formed into the configurations of FIGS. 1 and 7 by a drawing process. Any tubular member may be used provided it has as many flat sections as there are vane slots and the flat sections are connected by corner portions. The tubular member is preferably made of an iron-based material, an aluminum-based material, an aluminum matrix composite material, or the like.

In either embodiment, the slots that eventually comprise the vane slots are formed from the flat sections. These slots can be formed in opposite pairs as shown in FIGS. 2 and 3 and FIGS. 8 and 9 or the slots may be formed sequentially from the flat portions.

Figure 4:
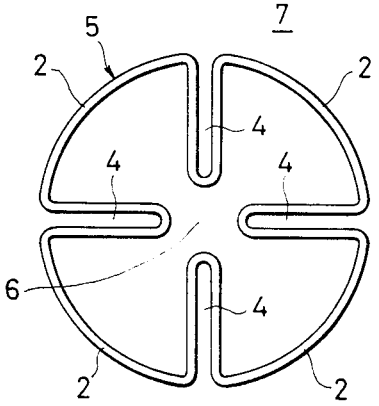
Figure 10:
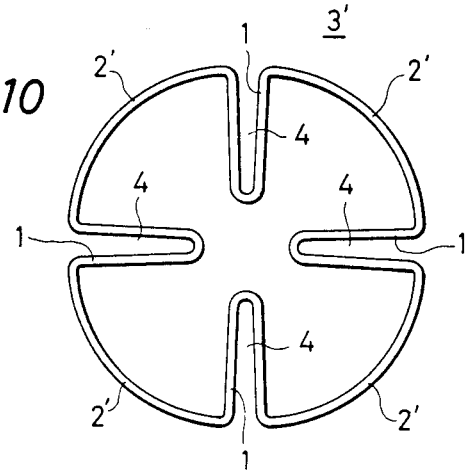

The slots formed in the tubular member are then formed into the vane slots by means of a die. In such an operation a precisely formed die is placed in contact with the partially formed member (e.g. that shown in FIG. 3 or FIG. 10) and the member is subjected to further deformation to form the slots 4 into the desired final configuration to obtain an outer peripheral surface depicted as 5 in FIG. 4. This deformation can be induced mechanically, hydraulically or even by explosive forming.

The corner portions, which may have a radius of curvature approximately that of the cylindrical rotor being formed, are formed into the outer peripheral surface of the rotor by means of a die. This can be carried out after the vane slots are finally formed but it is preferred that it be done simultaneously. This final shaping process may also be used to form the shaft passage 6 of FIGS. 4 and 11 in which the interior extremities of the vane slots 4 form the shaft passage.

Figure 5:
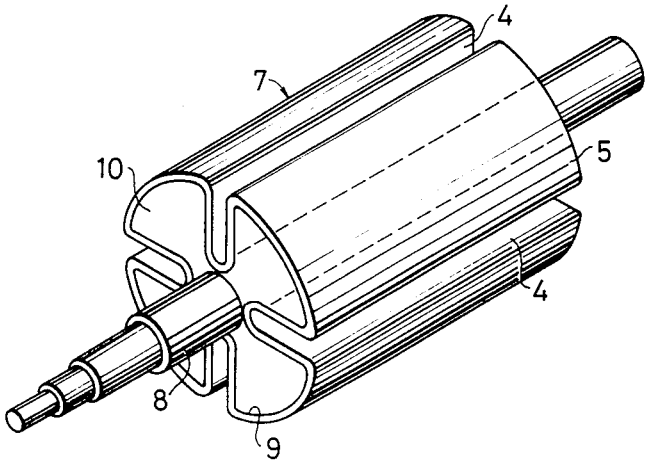
Figure 6:
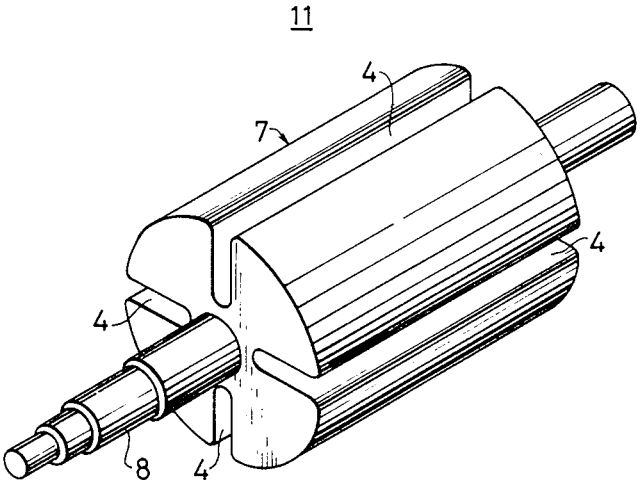

As shown in FIGS. 5 and 6, an elongated member (which may be solid or tubular) serving as a shaft 8 is inserted through the shaft passage 6 in the rotor body 7, and fixed therein by deforming the shaft in place or by welding. Preferably a mass of synthetic resin 10 is used to fill the hollow interior portions 9 in the rotor body 7 and hardened therein. The entire assembly may then be plated or otherwise treated to produce a rotor 11 as shown in FIG. 6.

Figure 11:
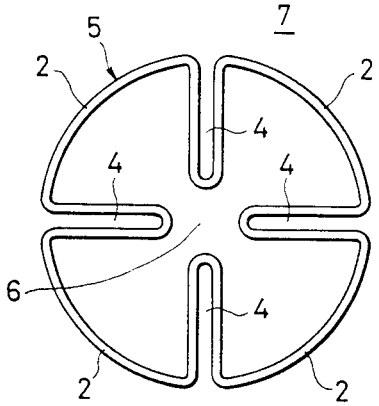
Figure 12:
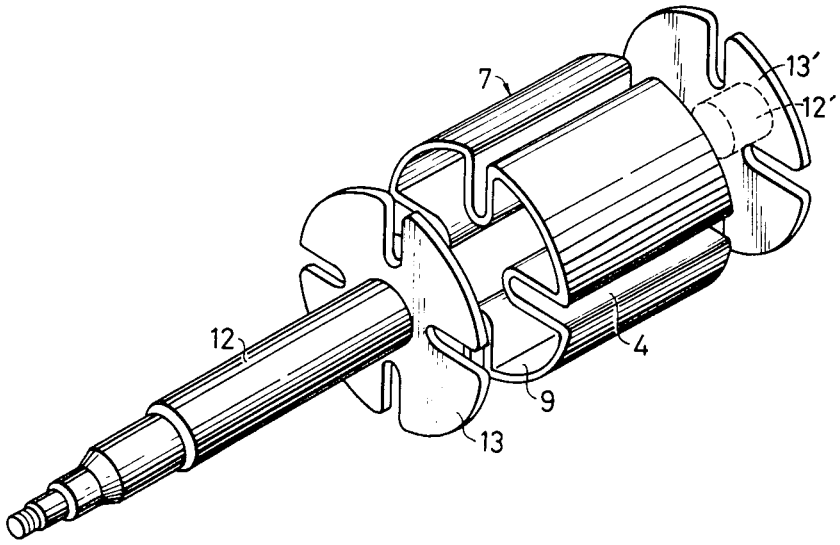
FIG. 12 is a perspective view illustrating the manner in which side plates may be joined to a rotor body.

The embodiment of FIGS. 11 and 12 is similarly formed. In such an embodiment after the rotor body is formed having an outer peripheral surface 5, side plates 13 and 13' having respective shafts 12 and 12' are welded to opposite ends of the rotor 7. The shafts 12 and 12′ and the side plates 13 and 13′ are formed or welded together into an integral construction, and are initially formed by casting or forging. The shaft may be disposed on only one of the side plates.

With the rotor manufacturing methods of the invention, the rotor can easily be manufactured. The interior of the rotor is hollow or contains a synthetic resin material. Therefore, the rotor of the invention is much lighter than conventional solid rotors, and considerably greater in rigidity than a solid rotor having the same weight.

The present invention has been disclosed in terms of preferred embodiments but the scope of the invention should not be limited thereto. The scope of the invention is determined by the appended claims and their equivalents.

What is claimed is:

1. A method of forming a rotor for a vane-type rotary fluid pump, said rotor being generally cylindrical with a plurality of vane slots therein, said method comprising the steps of:

(a) providing a tubular member having a plurality of generally flat sections and a plurality of corner portions between said flat sections;

(b) forming slots in said flat sections by deforming said tubular member;

(c) forming said slots into said vane slots by means of a die; and (d) forming said corner portions into the outer peripheral surface of said rotor by means of a die.

2. The method of claim 1 wherein steps (c) and (d) are done simultaneously with the same die.

3. The method of claim 1 wherein said slots are formed in said flat sections in opposite pairs.

4. The method of claim 1 wherein said slots are formed in said flat sections successively.

5. The method of claim 1 wherein said corner portions of said tubular member have a radius of curvature approximately that of the cylindrical rotor being formed.

6. The method of claim 1 including the step of fastening end plates to said cylindrical rotor.

7. The method of claim 6 including the step of fastening shaft means to at least one end plate of said rotor.

8. The method of claim 1 including the step of filing said rotor with a lightweight material.

9. The method of claim 8 wherein said lightweight material is a plastic resin.

10. The method of claim 1 wherein said tubular member is comprised of a metal selected from the group consisting of aluminum alloys and iron alloys.

11. The method of claim 1 wherein said tubular member is comprised of a fiber-reinforced metal matrix composite.

12. The method of claim 11 wherein said metal matrix is comprised of aluminum.

* * * * *